US007408469B2

(12) United States Patent
Norman et al.

(10) Patent No.: US 7,408,469 B2
(45) Date of Patent: Aug. 5, 2008

(54) SECURITY DEVICE FOR ELECTRICAL CORD

(75) Inventors: Michael Norman, East Brunswick, NJ (US); Chester Kolton, Westfield, NJ (US)

(73) Assignee: B&G Plastics, Inc., Newark, NJ (US)

( * ) Notice: Subject to any disclaimer, the term of this patent is extended or adjusted under 35 U.S.C. 154(b) by 254 days.

(21) Appl. No.: 11/447,224

(22) Filed: Jun. 5, 2006

(65) Prior Publication Data

US 2007/0008143 A1 Jan. 11, 2007

Related U.S. Application Data

(60) Provisional application No. 60/688,181, filed on Jun. 7, 2005.

(51) Int. Cl.
*G08B 13/14* (2006.01)

(52) U.S. Cl. ..... 340/572.8; 340/572.9; 439/346; 439/367

(58) Field of Classification Search ..... 340/572.9, 340/572.8, 572.1, 652, 656; 70/57.1; 439/346, 439/367

See application file for complete search history.

(56) References Cited

U.S. PATENT DOCUMENTS 4,060,297 A * 11/1977 Marshall et al. ..... 439/149
4,136,919 A * 1/1979 Howard et al. ..... 439/346
5,277,600 A * 1/1994 Meixler ..... 439/134
5,288,239 A * 2/1994 Johnson ..... 439/134
5,480,312 A * 1/1996 Watanabe et al. ..... 439/135
6,150,940 A * 11/2000 Chapman et al. ..... 340/568.3
6,234,823 B1 * 5/2001 Fuess ..... 439/346
6,462,668 B1 * 10/2002 Foseide ..... 340/687
6,589,067 B1 * 7/2003 Kolton et al. ..... 439/491
6,652,307 B2 * 11/2003 Tatz ..... 439/346
7,320,613 B1 * 1/2008 Ratzlaff ..... 439/345
2004/0163430 A1 * 8/2004 Belden, Jr. ..... 70/57.1
2004/0231375 A1 * 11/2004 Skjellerup ..... 70/57.1
2005/0184059 A1 * 8/2005 Clothier et al. ..... 219/618
2005/0184856 A1 * 8/2005 Pourchot ..... 340/5.61

* cited by examiner

*Primary Examiner*—Jeff Hofsass
*Assistant Examiner*—Jack K Wang
(74) *Attorney, Agent, or Firm*—Hoffmann & Baron, LLP

(57) ABSTRACT

The present invention provides a security device for attachment to an electrical cord. The device includes a housing assembly having an exterior housing and an interior housing. The interior housing having means to securely attach the plug inside the interior housing. The device also includes an exterior housing for inwardly receiving the interior housing and the attached plug. The interior housing snap locks into the exterior housing to provide a locking non-removable engagement therewith. Additionally, the housing has means to provide a tight engagement of the plug with the housing assembly.

15 Claims, 4 Drawing Sheets

SECURITY DEVICE FOR ELECTRICAL CORD

CROSS-REFERENCE TO RELATED APPLICATION

This application claims priority to U.S. Provisional Patent Application No. 60/688,181, filed on Jun. 7, 2005, which is incorporated herein by reference.

FIELD OF THE INVENTION

The present invention relates to a security device for electrical cord, more particularly to an electronic surveillance (EAS) security device securably attached to a plug of an electronic device.

BACKGROUND OF THE INVENTION

It is widely known to provide electronic surveillance (EAS) devices for theft deterrence. EAS devices may be placed on or attached to in various manners, to products which are susceptible to theft. Such products may include an electronic device or equipment having a means such as a plug to connect to a power supply. There has been an ongoing problem of securing these electronic devices from easy and quick theft. This problem is typically being solved by various locking arrangements. Many of these devices can be easily seen and removed thereby defeating the purpose of the device.

Therefore, a need exists to provide an anti-theft device that is securely locked to the electronic device without the consumer being aware that the device is being protected.

SUMMARY OF THE INVENTION

A security device for attachment to a plug of an electrical cord having a housing assembly. The housing assembly includes an interior housing for accommodating the plug. The interior housing includes an inwardly directed spring fingers. The assembly further includes an exterior housing for inwardly receiving the interior housing and the attached plug. The interior housing is non-removably engaged with the exterior housing. The exterior housing includes an internally directed ledges for forcing the spring fingers of the interior housing into locking engagement with the plug. The device additionally includes an EAS device supported within the assembly.

DETAILED DESCRIPTION OF THE INVENTION

Figure 1:
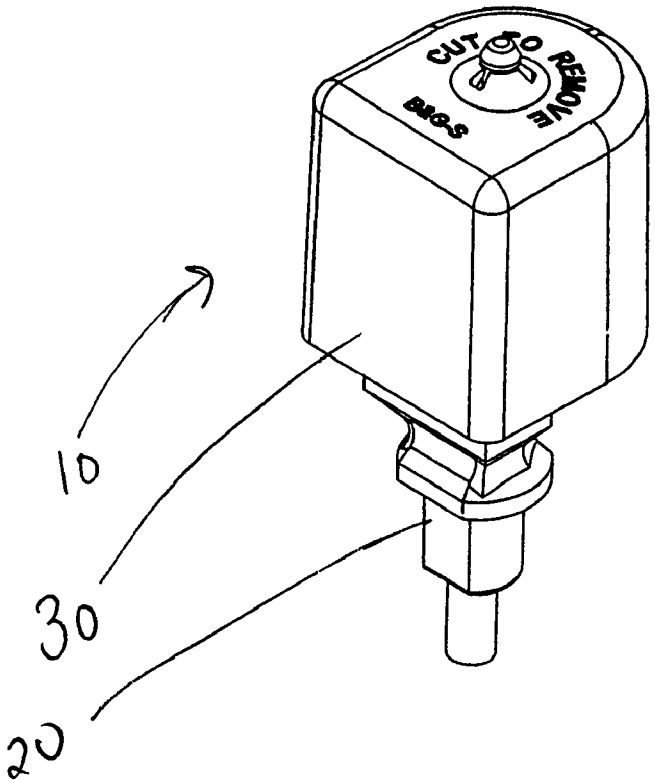
FIG. 1 is a perspective view of a preferred embodiment of the security device of the present invention with an electric cord.

Referring now to FIG. 1 of the present invention, there is shown a security device 10 attached to an electric cord plug with a power cord.

The device 10 includes a housing assembly 30 having an exterior housing and an interior housing. The device 10 is preferably shaped as a typical "mail box" with an open face and a cavity formed in the device 10.

Figure 2:
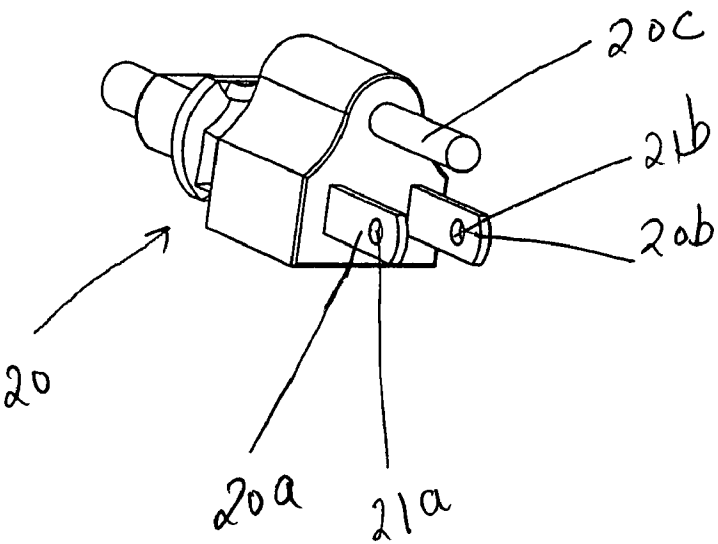
FIG. 2 is a perspective view of a typical electrical cord.

The cord plug 20 as shown in FIG. 2 typically contains three prongs 20*a*, 20*b* and 20*c* with two parallel prongs 20*a* and 20*b* as shown. The cord and plug are of conventional construction. The cord plug 20 is plugged into the cavity of the housing 30 as will be described in greater detail below.

Figure 3B:
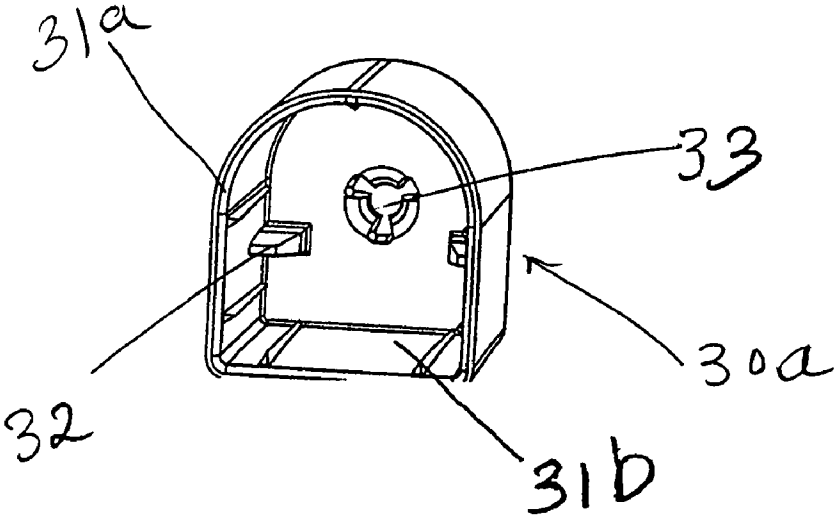
FIGS. 3A and 3B are perspective views, respectively, of the outer and inner view of the interior housing.
Figure 3A:
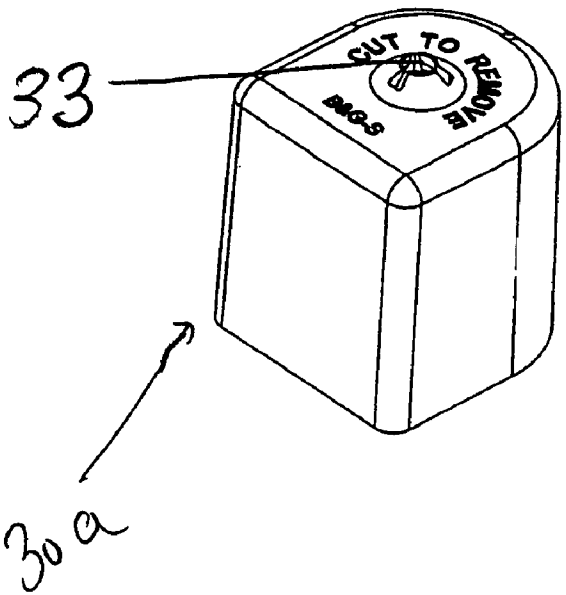

FIGS. 3A and 3B show an exterior housing 30*a* with an outer and inner view respectively.

The exterior housing 30*a* is preferably made of plastic and is clear in color. The exterior housing 30*a* includes an open face 31*a* and a cavity 31*b* formed in the exterior housing and further sized and shaped to accommodate the interior housing 30*b* within its cavity 31*b*. The exterior housing 30*a* includes a pair of the oppositely directed, internally directed ledges 32 as can be clearly seen in the inner view FIG. 3*b* of the exterior housing 30*a*. The exterior housing 30*a* further includes an aperture 33 extending outwards at its back wall. The aperture 33 is sized and shaped to snap lock the interior housing 30*b* as is described in greater detail hereinbelow.

Figure 3D:
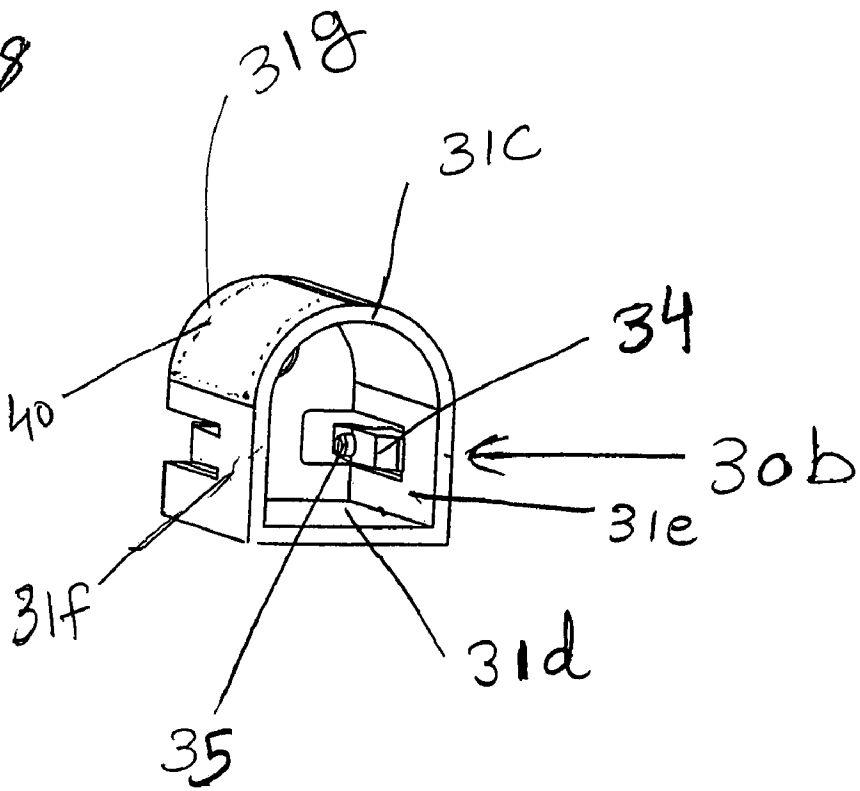
FIGS. 3C and 3D are perspective views, respectively, of the outer and inner view of the exterior housing.
Figure 3C:
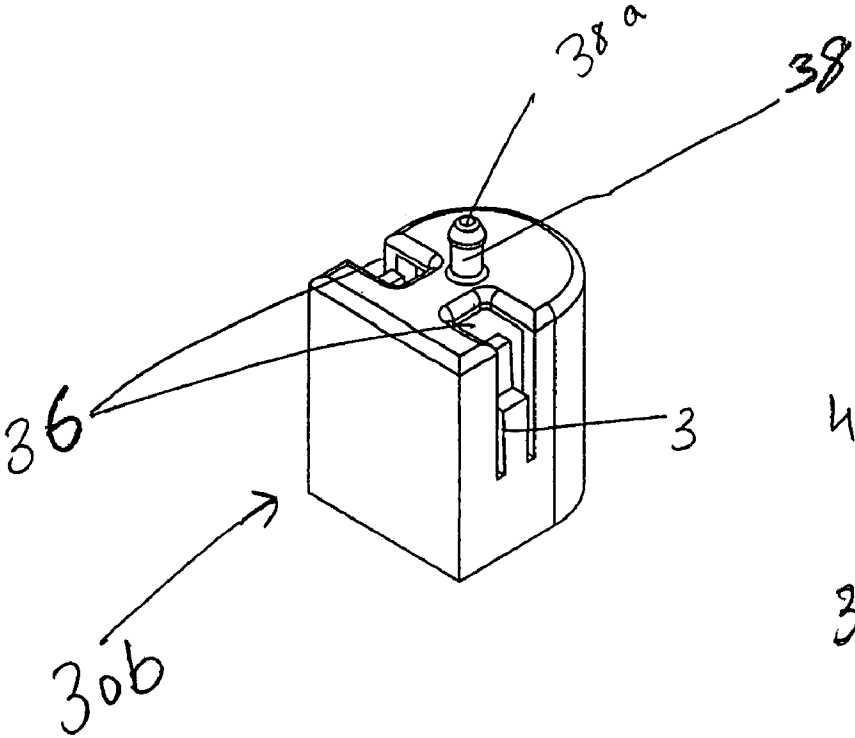

Now referring to FIGS. 3C and 3D, there is shown a perspective view of the interior housing 30*b* with an outer and inner view, respectively.

The interior housing 30*b* is also preferably made of plastic. The interior housing 30*b* is shaped and sized to fit into the exterior housing 30*a*. The interior housing 30*b* cavity also includes an open face 31*c* and a cavity 31*d* formed in the housing 30*b*. The interior housing 30*b* includes a pair of inwardly directed spring fingers 34 from the side walls 31*e* and 31*f* of interior housing 30*b* and resiliently pivotal extending therefrom. The spring fingers are engaged with the two parallel prongs 20*a* and 20*b* of the plug upon insertion. As seen clearly in the inner view of the interior housing FIG. 3D, the spring finger 34 further includes inwardly directed pins 35.

Certain typical plugs 20 as shown in FIG. 2 may preferably include indentations or apertures 21*a* and 21*b* on the parallel prongs 20*a* and 20*b* respectively. Upon insertion of the plug 20, the spring fingers 34 engage with the parallel prongs, 20*a* and 20*b* and the pins 35 snap directly into the indentations 21*a* and 21*b* of the parallel prongs 20*a* and 20*b*, thereby providing a tight engagement between the interior housing 30*a* and the plug 20.

Looking at the outer view FIG. 3C of the interior housing 30*b*, there is shown a pair of openings 36 on the back wall sized and shaped to receive the ledges 32 of the exterior housing 30*a* upon insertion of the interior housing 30*b* into the exterior housing 30*a*.

Also shown in FIG. 3C is a nib 38 extending outward from the back wall of the interior housing 30*b*. The extending nib 38 provides a tight engagement with the exterior housing 30*a* as will be described herein. The extending nib 38 includes an enlarged tip 38*a*. The extending nib 38 with its enlarged tip 38*a* is designed such that the tip 38 fits through the aperture 33 of the exterior housing 30*a* in an insertion direction. So, upon insertion of the interior housing 30*b* with attached plug 20 into the exterior housing 30*b*, the nib 38 snap locks into the aperture 33, with only the tip portion 38*a* extending out of the aperture 33. The walls of the aperture 33 are constructed to allow only one plug insertion of the tip therethrough. This provides a locking non-removable engagement between the exterior 30*a* and the interior 30*b* housing.

In order to unlock the security device 10, one would have to cut the enlarged tip 38*a* of the nib 38. This would cause the interior housing 30*a* to fall out of the exterior housing 30*b*, unlocking the device 10 and allowing the plug 20 to be withdrawn. Thus, the security device 10 can only be removed by destroying it.

The interior housing 30*b* shown in FIGS. 3C and 3D is designed to accommodate a standard EAS device, which, as well known in the art, is used with an EAS detection system to detect unauthorized movement of any product containing the EAS. While an EAS device is shown, the housing 30*b* may also accommodate other devices such as a radio frequency identification (RFID) tag.

A standard EAS is a rectangular member having two sides with adhesive coated onto one side. The EAS is preferably made of paper or plastic. The EAS 40 of the present invention is adhesively secured to the upper curved surface 31*g* of the interior housing 30*b* as shown in FIG. 3*d*. While the EAS 40 is preferably secured to the upper curved surface 31*g* of the interior housing 30*a*, it may be attached anywhere within the housing assembly 30.

Figure 4B:
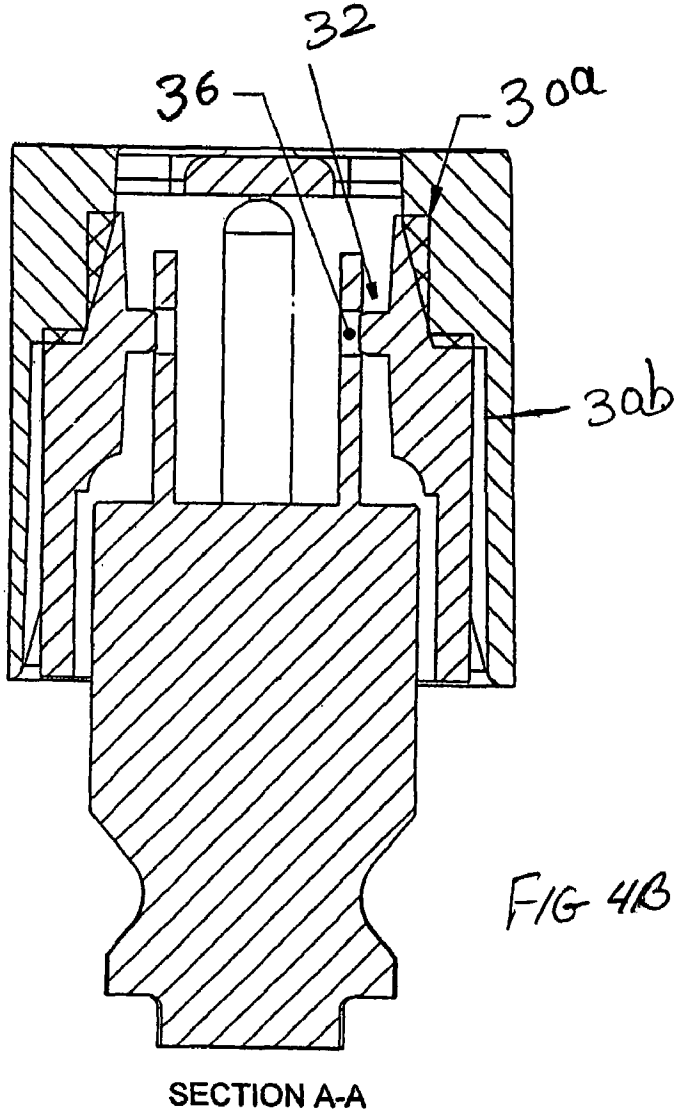
FIG. 4B is a cross-section plan view of the housing device taken along line 4B-4B of FIG. 4A.
Figure 4A:
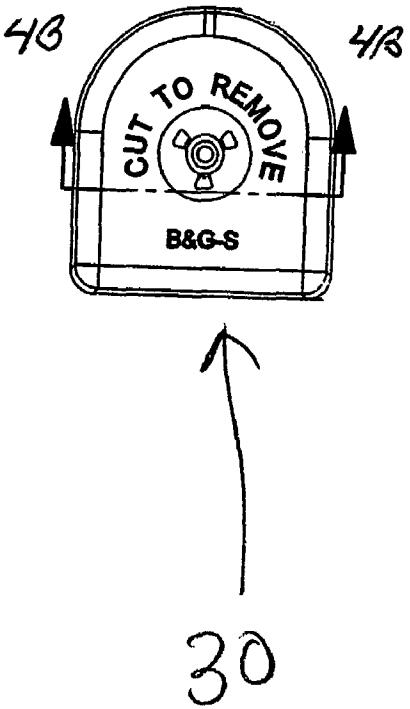
FIG. 4A is a perspective view of the rear portion of the housing device.

FIG. 4A shows a perspective view of the back wall of the housing assembly 30 of the security device 10. A cross-section view taken along line 4B-4B of FIG. 4A is shown in FIG. 4B to illustrate the tight engagement between the plug 20 and the housing 30. Upon insertion of the interior housing 30*b* into the exterior housing 30*a*, the ledges 32 are pushed into the openings 36 and bear against the spring fingers 34 forcing the spring fingers into tight engagement with the plug 20. This provides the spring fingers 34 to be in engagement and also prevents removal of the housing device 30 from the plug 20.

Thus, the present invention provides an EAS security device which can be attached to a plug. The device can not be easily removed without destroying it, thereby indicating that the device has been tampered with and the security device removed.

Various changes to the foregoing described and shown structures would now be evident to those skilled in the art. Accordingly, the particularly disclosed scope of the invention is set forth in the following claims.

What is claimed:

1. A security device for attachment to a plug of an electrical cord, said device comprising:

a housing assembly including:

an interior housing for accommodating said plug wherein said interior housing includes an inwardly directed spring fingers;

an exterior housing for inwardly receiving said interior housing, said exterior housing including an aperture for non-removably receiving said interior housing in said exterior housing;

said exterior housing having internally directed ledges for forcing said spring fingers into locking engagement with said plug; and an EAS device supported within said housing assembly.

2. The security device of claim 1 wherein said interior housing includes an outwardly extending nib which snap locks into the aperture of the exterior housing.

3. The security device of claim 1 wherein said ledges of the exterior housing bear against said spring fingers of the interior housing.

4. The security device of claim 1 wherein said fingers include pins for secure engagement with indentation of the plug.

5. The security device of claim 1 wherein said EAS device of claim 1 is adhesively secured to an upper surface of the interior housing.

6. A security device for attachment to a plug of an electrical cord, said device comprising:

a housing assembly including:

an interior housing for accommodating said plug, said interior housing including an inwardly directed spring fingers for engagement with said plug;

an exterior housing for inwardly receiving said interior housing, said exterior housing having internally directed ledges for forcing said spring fingers into locking engagement with said plug;

means for non-removably coupling said exterior housing with said interior housing; and an EAS device supported within said housing assembly.

7. The security device of claim 6 wherein said exterior housing includes a nib receiving aperture.

8. The security device of claim 6 wherein said interior housing includes an outwardly extending nib to snap lock into said aperture.

9. The security device of claim 6 wherein said ledges of the exterior housing bear against the spring fingers of the interior housing to provide a tight engagement therewith.

10. The security device of claim 6 wherein said EAS device of claim 1 is adhesively secured to an upper surface of the interior housing.

11. A security device for attachment to a plug of an electrical cord, said device comprising:

an interior housing for accommodating said plug, said interior housing having an outwardly extending nib;

an exterior housing for inwardly receiving said interior housing, said exterior housing having a nib receiving aperture for non-removably receiving said interior housing to said exterior housing to form a housing structure;

means for locking the housing structure to said plug upon engagement therewith; and an EAS device supported within said housing assembly.

12. The security device of claim 11, wherein said outwardly extending nib of the interior housing snap lock into said aperture of the exterior housing for tight engagement therewith.

13. The security device of claim 11, wherein said exterior housing include an internally directed ledges for forcing said spring fingers into locking engagement with said plug.

14. The security device of claim 11 wherein said ledges of the exterior housing bear against said spring fingers of the interior housing.

15. The security device of claim 11 wherein said EAS device of claim 1 is adhesively secured to an upper surface of the interior housing.

* * * * *